US005562964A

United States Patent [19]

Jones

[11] Patent Number: 5,562,964

[45] Date of Patent: Oct. 8, 1996

[54] PERFORATED ROLLED PAPER OR NONWOVEN PRODUCTS WITH VARIABLE BONDED LENGTH AND METHOD OF MANUFACTURING

[75] Inventor: Richard E. Jones, Winneconne, Wis.

[73] Assignee: Kimberly-Clark Corporation, Neenah, Wis.

[21] Appl. No.: 356,411

[22] Filed: Dec. 14, 1994

[51] Int. Cl.[6] ..... B65D 65/28; G09F 3/00

[52] U.S. Cl. ..... 428/43; 428/44; 428/174; 428/192; 428/212; 206/820; 383/207

[58] Field of Search ..... 428/43, 44, 174, 428/192, 212, 220, 224; 283/100; 206/820; 383/207

[56] References Cited

U.S. PATENT DOCUMENTS

| | | | |
|---|---|---|---|
| 3,822,588 | 7/1971 | Knight et al. | 73/81 |
| 4,214,024 | 7/1980 | Jacobson | 428/41 |
| 4,238,541 | 12/1980 | Burton | 428/43 |
| 4,457,964 | 7/1984 | Kaminstein | 428/43 |
| 4,535,950 | 8/1985 | Lisnyansky | 242/66 |
| 4,817,883 | 4/1989 | Hoffmann et al. | 242/66 |
| 4,982,845 | 1/1991 | Prascak et al. | 206/621 |
| 5,334,126 | 8/1994 | Moll | 493/22 |
| 5,341,824 | 8/1994 | Fletcher et al. | 131/281 |
| 5,372,494 | 12/1994 | Vaughan | 425/196 |

*Primary Examiner*—William A. Krynski
*Attorney, Agent, or Firm*—Gregory E. Croft

[57] ABSTRACT

Improved detaching of perforated roll products of paper or nonwovens is achieved by selectively reducing strength of the sheet along the perforation line at the edges of the sheet. This is achieved by lowering the bonded length (the sum total of the distance between perforations) at the edges of the sheet relative to that within the central portion of the sheets. Greater bonded lengths in the middle of the sheet enable the sheet to pass through converting operations with minimal breaks, while having lower bonded lengths at the outer edges allows the user to more easily start a tear in the sheet at the perf line and reduce the number of "ears" left on the roll as a result of detaching.

8 Claims, 2 Drawing Sheets

PERFORATED ROLLED PAPER OR NONWOVEN PRODUCTS WITH VARIABLE BONDED LENGTH AND METHOD OF MANUFACTURING

BACKGROUND OF THE INVENTION

Rolled tissue products, as well as other rolled paper or nonwoven products, are typically perforated ("perfed") in order to facilitate the tearing off of the desired length of product for the intended use in a neat and undamaged fashion. In tissue products, the perforations facilitate easy removal of the required number of sheets. The perforations are normally provided in transverse perforation lines across the roll width, which are uniformly spaced in the machine direction of the roll. The lines of perforations comprise alternating bonds and perfs which are of uniform length and spacing. The perfs are typically rectangular slits or round holes with transverse orientation.

Perforating devices are well known in the papermaking art and are incorporated into almost all bathroom tissue and towel winders as well as other converting equipment in a typical tissue manufacturing and converting plant. These devices comprise a perforator roll, which holds a number of perf blades, and a stationary anvil head, which holds a number of anvil assemblies. The anvil assemblies are typically positioned helically (on a curve) on the stationary anvil head so as to keep all of the perforator blades from striking all of the anvils at the same time, thus minimizing the amount of vibration at the point of perforation. The perf blades themselves are typically 4.5 inches long, 0.875 inch wide, and from about 0.030 to 0.040 inch thick. The perf blades are typically specified by the length of the bonds (nonperforated segments of the perforation line) and the number of bonds per blade. Thus a typical 4.5 inches long perf blade might be designated as a 0.020 inch×40, indicating that its bonds were 0.020 inch long and that there were 40 such bonds on each 4.5 inches long perf blade. In the converting process a balance must be struck between having perforation lines that have sufficient bond strength to operate efficiently and without breaks on the converting equipment, and yet have low enough bond strength to provide easy and undamaged sheet detaching for the consumer. Nevertheless, in spite of efforts to achieve this proper balance, poor detaching has always been one of the major consumer complaints for rolled tissue products such as toilet tissue or kitchen towels.

Poor detaching usually manifests itself to the consumer as the incomplete removal of a sheet of tissue at the line of perforations. Usually the web will start to tear at the perforation line, but as the tear progresses across the line of perforation in the roll width, the web will start to tear longitudinally in the machine direction rather than transversely across the roll at the perforations. The result is typically the leaving of an "ear" or piece of sheet that had been detached at the far end of the roll from which the detaching had been initiated. Another fairly common problem is that the perf bond strength is too high, favoring good operation of the converting equipment, but when the sheet is detached, the web initially tears in some spot other than at the line of perforation. The leaving of "ears" is by far the more common problem of the two. The problems associated with poor detaching are normally worse in two-ply products than in one-ply products, and they are particularly bad in two-ply products that have poor attachment of the two plies, such as two-ply towels that are mechanically attached by embossing rather than being embossed and then glued together.

Hence there is a need to provide a perforated product that detaches more uniformly and completely at the perforations such that the detached sheet is in its whole undamaged form after detaching. There is also a need to maintain good operational efficiency of the converting equipment without the frequent "blow outs" or sheet breaks that can be caused by trying to operate converting equipment when the perforation line bonds are too weak.

SUMMARY OF THE INVENTION

It has now been discovered that sheet detaching can be significantly improved by customizing the perf blades used in the converting equipment so that the perforation lines in the sheet have a lower bonded length and lower bond strength at or near the outer edges of the sheet than they do across the rest of the sheet. This is accomplished using perf blades that provide different levels of bonding strength in the appropriate areas of the perfed sheet.

Hence, in one aspect, the invention resides in a rolled web of paper or nonwoven material comprising a plurality of spaced-apart lines of perforations extending transversely across the web, said lines of perforations having alternating perforations and individual bonded lengths, wherein the length or spacing of the perforations is nonuniform across the web width and wherein the percent bonded length is lower at the edge of the web relative to the central portion of the web. As used herein, "individual bonded length" is the length of a nonperforated segment of the web in the line of perforation. Said another way, it is the distance between adjacent perforations. The "percent bonded length" is the percentage of the perforation line occupied by individual bonded lengths for a given portion of the web, such as the edges or the central portion of the web. The "edge" of the web, for purposes herein, is the outer 25 percent of the web width. However, it is not necessary that the entire edge of the web have a lower percent bonded length than the central portion. For example, detachment can be improved even if only the outermost 10 percent of the web width has a lower percent bonded length than the central portion of the web. Therefore each line of perforation within a web can be divided into a central portion (50 percent of its length) and two edge portions (each 25 percent of its length).

In another aspect, the invention resides in a method of manufacturing a rolled web of paper or nonwoven material comprising differentially perforating the web with a plurality of spaced-apart perf blades to provide spaced-apart lines of perforations extending transversely across the web, said perforations being nonuniform in length and/or spacing across the web width, wherein a lower percent bonded length is provided at the edges of the web relative to the central portion of the web.

The difference in percent bonded length between the edges and the central portion of the web need not be large on an absolute basis. Absolute percent boned length differences can be about 2 percent or greater, more specifically from about 2 percent to about 25 percent, more specifically from about 2 to about 10 percent, and still more specifically from about 2 to about 5 percent. In any given instance, the difference in percent bonded length will largely depend upon the overall strength of the web and the percent bonded length in the central portion of the web. For kitchen towels, for example, the percent bonded length in the central portion of the towel typically ranges from about 17 to about 35 percent.

For bath tissue, the percent bonded length in the central portion of the tissue is often higher, typically from about 30 to about 50 percent.

DETAILED DESCRIPTION OF THE DRAWINGS

Figure 1:
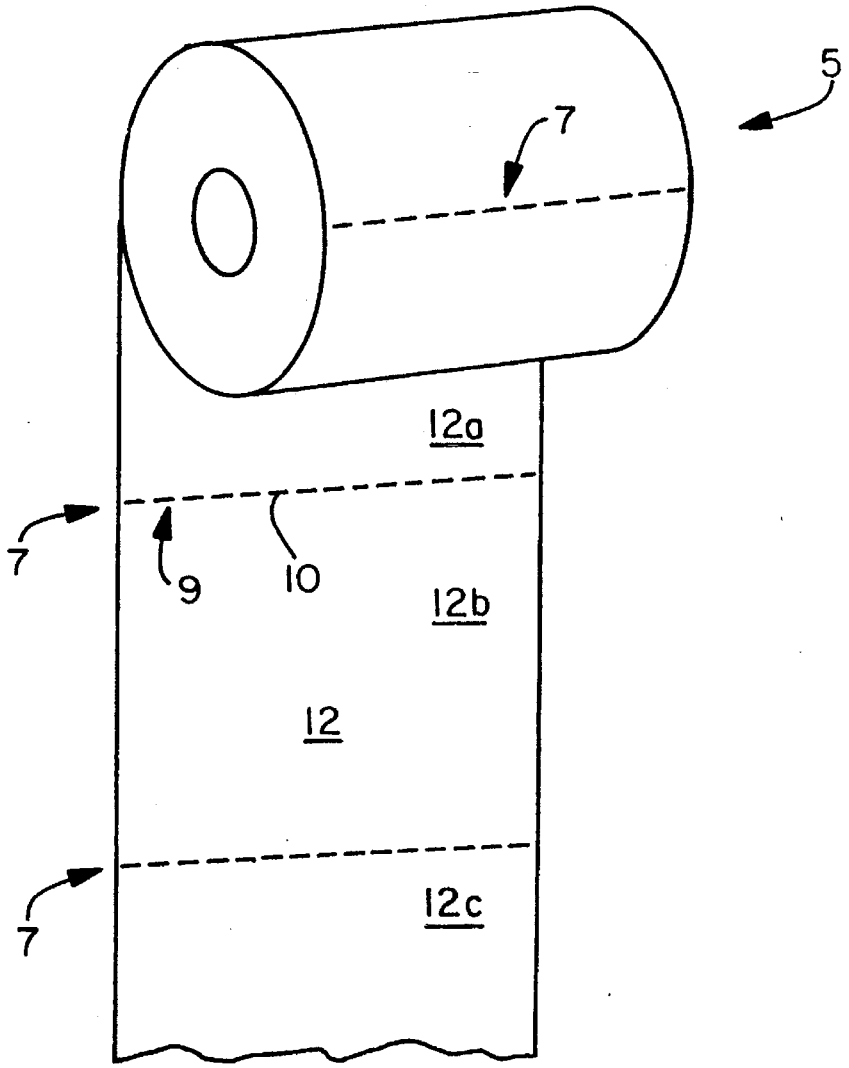
FIG. 1 is an isometric view of a roll of paper, such as a roll of kitchen towels or toilet paper, illustrating the spaced-apart perforation lines extending transversely across the width of the web.

Referring to FIG. 1, shown is a roll of paper 5, such as toilet paper or kitchen towels, which has evenly spaced-apart transverse perforation lines 7 which extend across the full width of paper web 12. As previously discussed, the perforations create a line of reduced strength which encourages the tearing off and separation of individual sheets of paper 12*a*, 12*b* and 12*c* of a predetermined size. The perforation lines consist of individual bonded lengths or bonds 9 and spaced apart by perforations or perfs 10.

Figure 2:
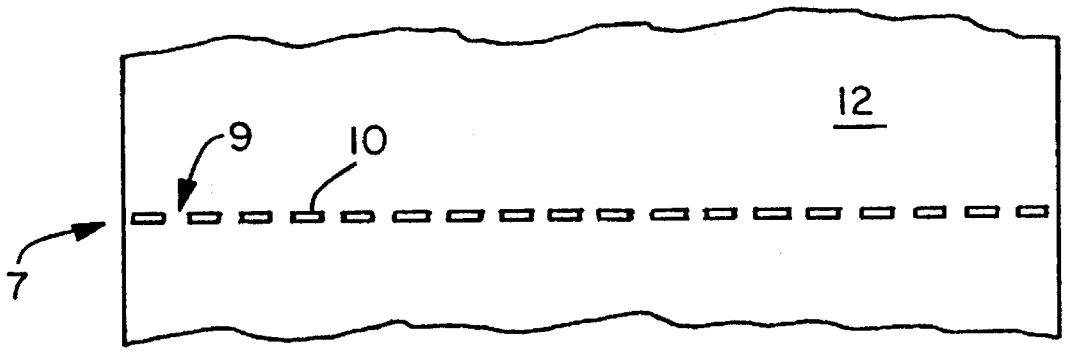
FIG. 2 is an enlarged plan view of a portion of a web having a conventional line of perforations, illustrating the uniform perfs and bond lengths.

FIG. 2 is an enlarged view of a typical perforation line. In normal perfing practice, the bonded lengths and perf lengths are uniform across the width of the sheet or roll as shown. The shape of the perfs can vary, although rectangular perfs are common.

Figure 3:
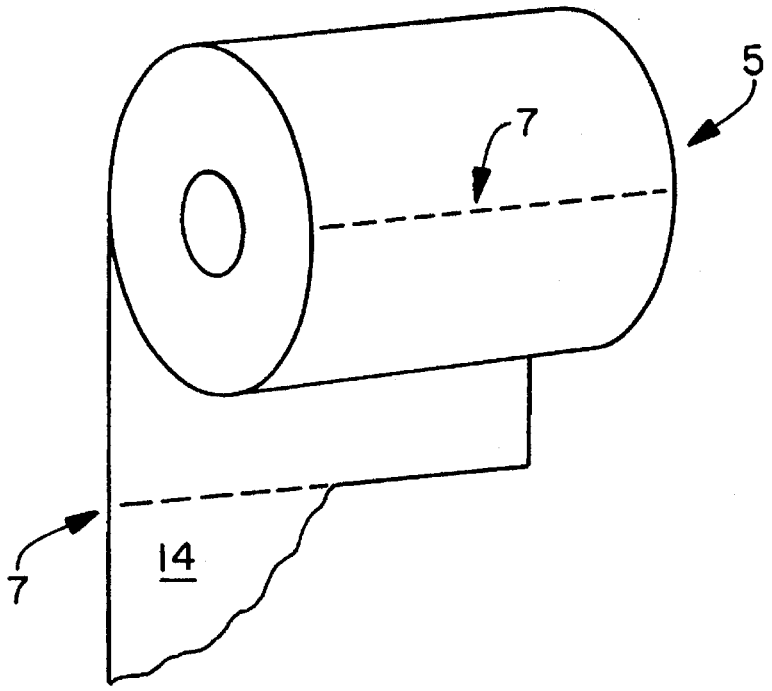
FIG. 3 is an isometric view of a roll of kitchen towels having an undesirable ear or tab still remaining after the previous towel was detached.

FIG. 3 illustrates an example of poor detaching where the sheet being torn off does not detach cleanly at the perforation line. A portion of the sheet 14 remains with the roll, resulting in the dispensing of an incomplete sheet. The portion of the sheet that remains is commonly referred to as a "tab", "tail" or "ear."

Figure 4:
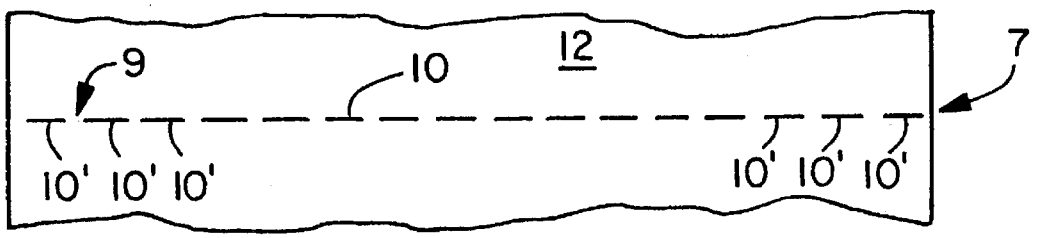
FIG. 4 is plan view of a portion of a web in accordance with this invention, in which the line of perforations contains a plurality of equally-spaced perforations which are longer at both edges of the web, thereby resulting in lower percent bonded length and lower strength in these areas relative to the central portion of the web.

FIG. 4 illustrates a plan view of a sheet or web in accordance with this invention in which the perforation line provides a lower bonded length at the edges of the sheet relative to the central portion. This is achieved by increasing the length of the perfs 10' at the edges of the sheet, while maintaining the spacing between the perfs (individual bonded lengths) the same across the sheet.

Figure 5:
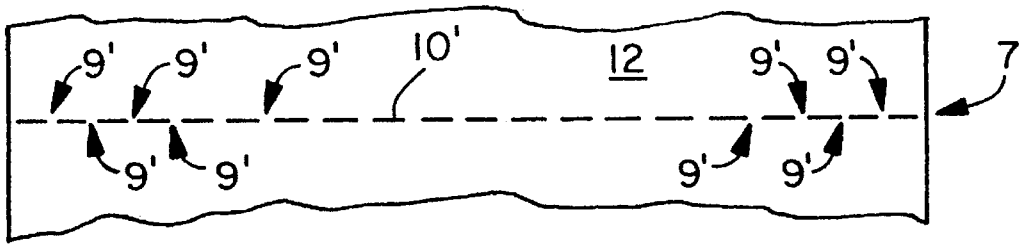
FIG. 5 is a plan view of a portion of a web in accordance with this invention similar to FIG. 4, but in which all of the perforations are of the same length and are spaced closer together at the edges of the web, resulting in smaller individual bonded lengths and lower percent bonded length and lower strength at the edges of the web relative to the central portion of the web.

FIG. 5 illustrates a plan view of another sheet or web in accordance with this invention, in which the lower percent bonded length at the edges of the sheet is achieved by reducing the spacing between the perfs 9' (individual bonded lengths) at the edges of the sheet, while maintaining the length of the perfs the same across the sheet.

Although the foregoing description has focussed on transverse slits as perforations, it will be appreciated that the perforations can take the form of slits, holes, inclined slits, chevrons or any combination of patterns or configurations that may be used with one another to create weaker bonding levels (lower percent bonded length) at the edges of the sheet compared to that found in the center of the sheet. Similarly, the lower percent bonded lengths at the edges of the sheet can be achieved by a combination of shorter perf spacing and longer perfs at the edges.

EXAMPLES

Two-ply kitchen toweling, in which the plies had been mechanically attached, was perforated in the normal manner (Control) and in accordance with this invention. For the control product, the perforations were 0.024"×35 (24 thousandths bond width, with 35 bonds per 4.5" perf blade width). In the examples of this invention, the bonded length (detaching strength) was reduced in the outside ¾ of an inch for each edge of the 11" wide kitchen towel sheet. The perfs and the bond lengths in the center 9.5" of the roll width were the same as in the Control. Ten rolls with 80 sheets per roll of each were tested for detaching using a mechanical detachment device. The device ensures that the detachment conditions are always the same and eliminates human error. The device essentially comprises spring loaded pivot arm having a clip for grasping the sheet of toweling. A trigger means releases the pivot arm, under spring tension, which swings down and to the side to tear the sheet from the roll. If the tear was clean and the entire sheet was removed, it was considered good detaching. If not, it was considered poor detaching and the width of the ear was measured (in inches). Results of the detaching testing are set forth in Table 1.

TABLE 1

| | Perforations | | Percent Bonded Length | | Poor | Ear |
|---|---|---|---|---|---|---|
| Test Sample | Edges | Middle | Edges | Middle | Detach | Width |
| "E" Control | .026 × 40 | Same | 23.1 | 23.1 | 413 | 2.94 |
| "M" Control | .024 × 35 | Same | 18.6 | 18.6 | 208 | 2.10 |
| "L" Invention | .018 × 40 | .024 × 35 | 16.0 | 18.6 | 190 | 2.37 |
| "J" Invention | .016 × 40 | .024 × 35 | 14.2 | 18.6 | 195 | 2.61 |
| "Q" Invention | .015 × 40 | .024 × 35 | 13.3 | 18.6 | 173 | 2.51 |
| "K" Invention | .013 × 40 | .024 × 35 | 11.6 | 18.6 | 108 | 2.27 |

This data clearly indicates that the number of poor detachments decreases as the bonded lengths at the outer edges of the towel sheet were shortened compared to the Controls. The data also suggests that since most of the "ears" left due to poor detaching are in the 2–2.5 inch range, it would probably further improve the detaching if the weaker bonded area were extended inwardly from 0.75 in. on each edge to 2.5 in. on each edge of the towel roll.

It will be appreciated that the foregoing examples, given for purposes of illustration, are not to be construed as limiting the scope of this invention, which is defined by the following claims and all equivalents thereto.

I claim:

1. A rolled web of paper or nonwoven material comprising a plurality of spaced-apart lines of perforations extending transversely across the web, said lines of perforation having alternating perforations and individual bonded lengths, wherein the length or spacing of the perforations is nonuniform across the web width and wherein the percent bonded length is lower at the outer 25 percent of the web width relative to the central portion of the web.

2. The web of claim 1 wherein the percent bonded length is lower at the outer 10 percent of the web width relative to the central portion of the web.

3. The web of claim 1 wherein the percent bonded length at each outer 25 percent of the web width is about 50 percent less than the percent bonded length in the central portion of the web.

4. The web of claim 1 wherein the outer 25 percent of the web width has a greater number of perforations per inch than the central portion of the web.

5. The web of claim 1 wherein the outer 25 percent of the web width has a lower number of perforations per inch than the central portion of the web.

6. The web of claim 1 wherein the outer 25 percent of the web width has the same number of perforations per inch as the central portion of the web.

7. The web of claim 1 wherein the outer 25 percent of the web width has a different number of perforations per inch relative to the central portion of the web.

8. The web of claim 1 wherein the outer 25 percent of the web width has fewer individual bonded lengths and shorter individual bonded lengths than the central portion of the web.

* * * * *